US008256140B2

(12) United States Patent
Lagrand et al.

(10) Patent No.: US 8,256,140 B2
(45) Date of Patent: Sep. 4, 2012

(54) PERSONAL TRACTION DEVICE

(75) Inventors: Kate Lagrand, Portland, OR (US); Marjory A. Wall, Portland, OR (US)

(73) Assignee: Kako International Inc., Portland, OR (US)

( * ) Notice: Subject to any disclaimer, the term of this patent is extended or adjusted under 35 U.S.C. 154(b) by 381 days.

(21) Appl. No.: 12/673,112

(22) PCT Filed: Jan. 6, 2010

(86) PCT No.: PCT/US2010/020272

§ 371 (c)(1), (2), (4) Date: Feb. 11, 2010

(87) PCT Pub. No.: WO2010/085375

PCT Pub. Date: Jul. 29, 2010

(65) Prior Publication Data

US 2011/0094128 A1 Apr. 28, 2011

Related U.S. Application Data

(60) Provisional application No. 61/146,263, filed on Jan. 21, 2009.

(51) Int. Cl.
*A43B 13/16* (2006.01)
*A43C 15/06* (2006.01)

(52) U.S. Cl. ..... 36/7.6; 36/62; 36/67 A

(58) Field of Classification Search ..... 36/7.6, 36/62, 67 A, 7.7, 64, 61, 59 R
See application file for complete search history.

(56) References Cited

U.S. PATENT DOCUMENTS

| | | | | |
|---|---|---|---|---|
| 618,774 | A * | 1/1899 | Blandford | 36/7.7 |
| 1,335,387 | A * | 3/1920 | Petrauskas | 36/61 |
| 1,408,388 | A * | 2/1922 | Noblette | 36/7.7 |
| 1,412,344 | A | 4/1922 | Devlin | |
| 1,734,487 | A | 1/1929 | German | |
| 3,355,823 | A | 12/1967 | Vogt | |
| 5,103,885 | A | 4/1992 | Chang | |
| D377,710 | S | 2/1997 | Poust | |
| D394,740 | S | 6/1998 | Poust | |
| 5,813,143 | A | 9/1998 | Bell | |
| 5,966,840 | A | 10/1999 | Bell | |
| 6,742,286 | B2 | 6/2004 | Giovale | |
| 2003/0154626 | A1 | 8/2003 | Larson | |
| 2004/0045190 | A1 | 3/2004 | Washburn | |
| 2005/0198860 | A1 | 9/2005 | Laeson | |
| 2007/0056187 | A1 | 3/2007 | Burgess | |
| 2007/0113424 | A1 | 5/2007 | Bell | |
| 2007/0163146 | A1 | 7/2007 | Brovkin | |

FOREIGN PATENT DOCUMENTS

| | | |
|---|---|---|
| CN | 2772283 | 4/2006 |
| WO | 97/06707 | 2/1997 |
| WO | 2010/016854 | 2/2010 |

OTHER PUBLICATIONS

Oct. 31, 2011 CN Office action in corresponding application CN2010080000686.4, 7 pages.

(Continued)

*Primary Examiner* — Ted Kavanaugh
(74) *Attorney, Agent, or Firm* — Hancock Hughey LLP

(57) ABSTRACT

Provided is a personal traction device that includes a traction mechanism that is very comfortable underfoot, while providing excellent traction over slippery surfaces as well as excellent long-term wear.

13 Claims, 4 Drawing Sheets

OTHER PUBLICATIONS

32north, catalog, 1 page, "Stabilicers" products Jan. 30, 2008.
Talon Development, catalog, 1 page, "Ice/Shoe Cleats" Jan. 30, 2008.
Duenorth, catalog, 1 page, "All Purpose Terrain Aids" Jan. 30, 2008.
Kahtoola, catalog, 1 page, "Microspikes," Jan. 30, 2008.

* cited by examiner

PERSONAL TRACTION DEVICE

FIELD OF THE INVENTION

This invention pertains to personal traction devices that can be worn over footwear such as shoes or boots so that traction mechanisms extend over the sole of the shoe for increasing the traction of the sole.

BACKGROUND OF THE INVENTION

There are many versions of personal traction devices that can be mounted to shoes, boots, or the like, for increasing traction when walking on ice or snow-covered surfaces.

Such devices often include stretchable mounting straps that are configured to grasp the toe and heel portions of the boot. The traction mechanisms are connected to the straps and may be in the form of chains, flexible material with embedded metal studs, or other material with roughened or irregular surfaces that extend across the sole of the boot, usually in the vicinity of the sole that underlies the heel and metatarsal portion of the foot.

A number of factors must be considered when designing such traction devices. For example, some mechanisms that provide very good traction, such as outwardly projecting metal spikes, may suffer from rapid wear or be uncomfortable to walk on for a length of time, especially when one is in an environment where the walking surface may change between dry, hard surfaces and icy or snow-packed surfaces. Also, it is difficult to durably mount metallic members, such as spikes or studs, to a flexible cross strap or the like. To this end, some designs provide for replacing dislodged or worn spikes, which necessarily increases the cost and complexity of the device.

Some mechanisms that extend across the sole of the shoe or boot, such as relatively low-profile chains or coiled spring-like members may be more comfortable to the user, but they typically have less aggressive traction characteristics.

The present invention is directed to a personal traction device that provides a traction mechanism that is very comfortable underfoot, while providing excellent traction over slippery surfaces as well as excellent long-term wear.

DESCRIPTION OF PREFERRED EMBODIMENTS

Figure 1:
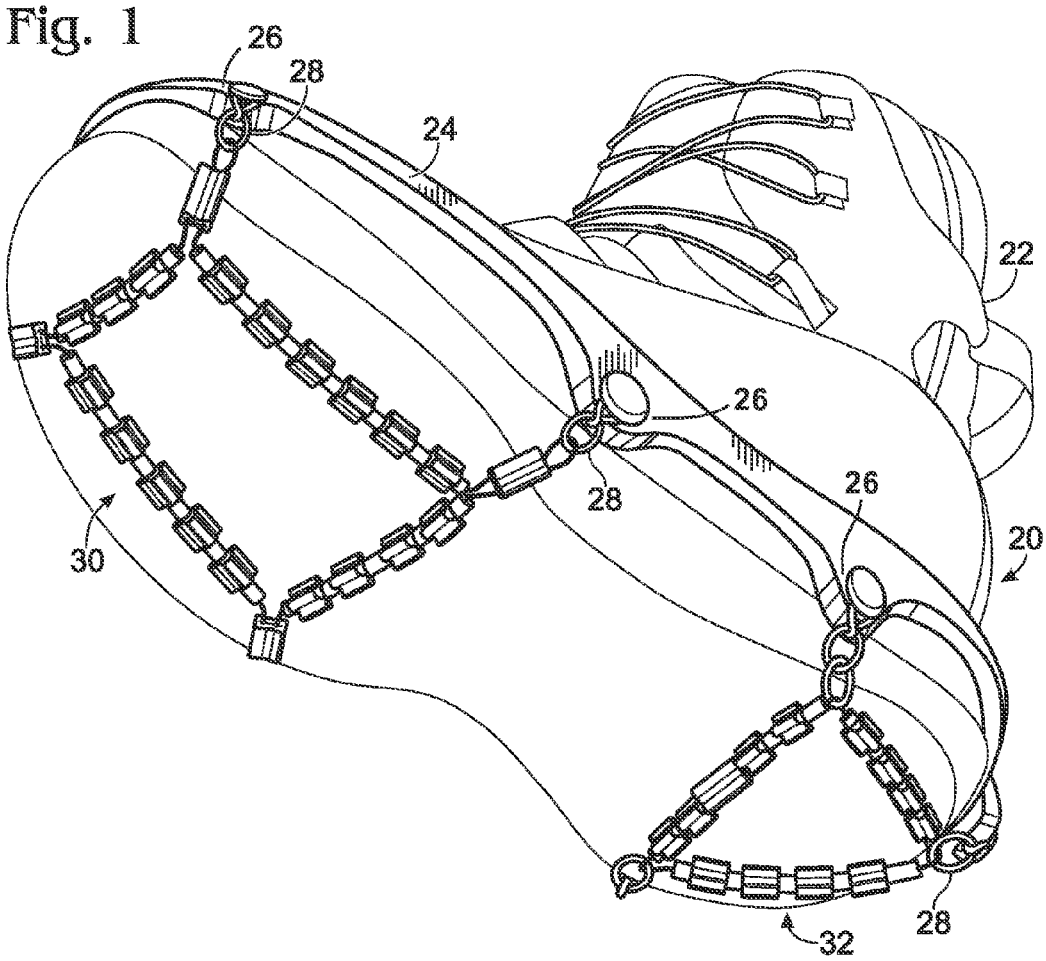
FIG. 1 is a perspective view of a personal traction device in accord with the present invention shown mounted to a boot.

FIG. 1 illustrates the traction device 20 mounted to a boot 22. A generally ring-shaped elastomeric member 24 is stretched around the boot, above the sole of the boot. The elastic properties of that member 24, as well as the friction between the member and the boot, secure that member in place.

The elastomeric member 24 is formed with several downwardly projecting tabs 26. Each tab 26 is formed with an aperture for receiving a connector link 28 of a cable assembly 30, 32 that extends across the sole (underside) of the shoe as described more fully below.

Figure 2:
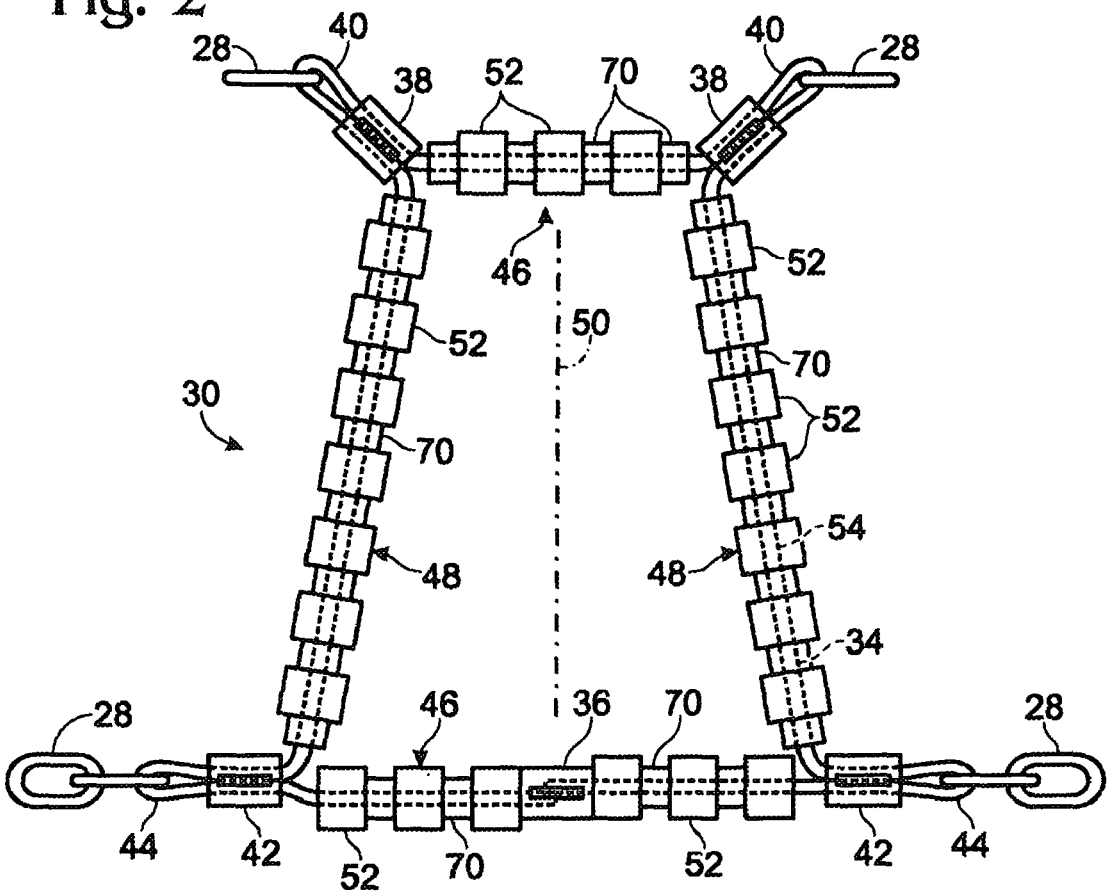
FIG. 2 is a plan view of a forward or toe assembly component of the personal traction device.

FIG. 2 is a plan view of the forward or toe cable assembly 30 of the personal traction device. This assembly comprises a single length of stainless wire rope 34, shown in dashed lines, and preferably having a 0.0625-inch (1.6 mm) diameter. The ends of the rope 34 are overlapped and fastened by a crimp 36.

Crimps 38 are also applied in two places near the forward part of the rope to define two spaced-apart, forward connector loops 40 in the rope. Each of these loops is captured by one of the above mentioned connector links 28 that extend from each tab 26 of the elastomeric member 24.

Similarly, crimps 42 are applied in two places near the rearward part of the rope to define two spaced-apart, reward connector loops 44 in the rope. Each of these loops is also captured by a connector link 28 that extends from a tab 26 of the elastomeric member 24.

With continued reference to FIG. 2, the overall wire rope 34 can be considered as having four segments, each segment extending between a connector loop. For example, a transverse segment 46 of the assembly extends between the forward connector loops 40. Another transverse segment 46 extends between the rearward connector loops 42. A lengthwise segment 48 extends between a forward connector loop 40 and rearward loop 44 on each side of the assembly.

As seen in FIG. 2, the segments are arranged in a generally trapezoidal shape, with the two lengthwise segments extending along, but not parallel to, the long centerline 50 of the assembly (that centerline corresponding to the centerline of the boot to which the assembly is attached). The two transverse segments 46 extend generally across and perpendicular to that centerline 50.

Figure 4:
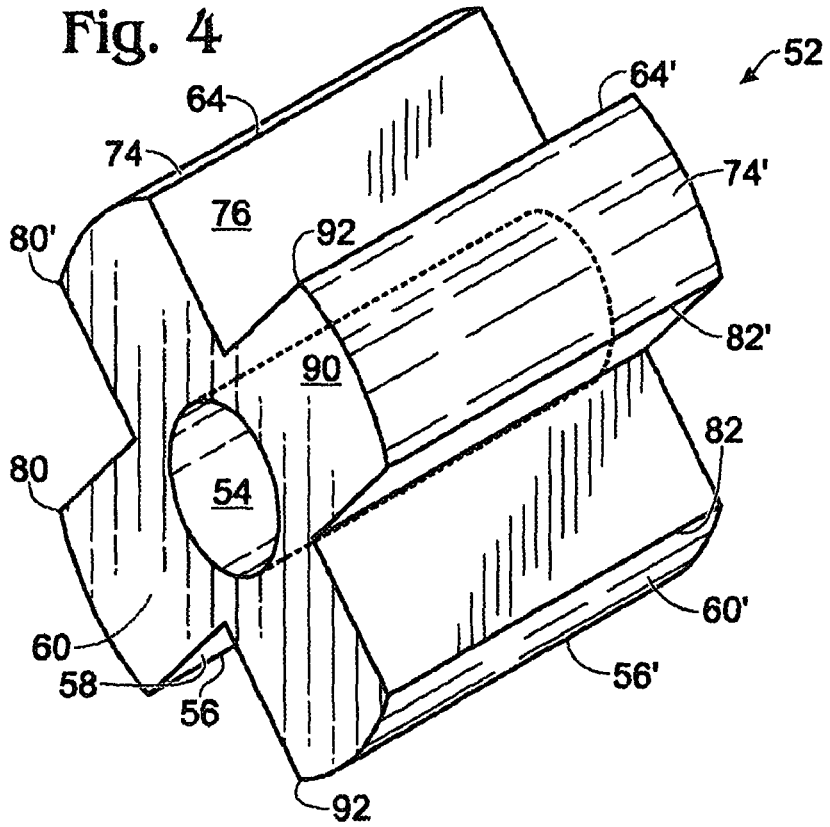
FIG. 4 is a perspective, enlarged view of one embodiment of a cleat component of the personal traction device.
Figure 5:
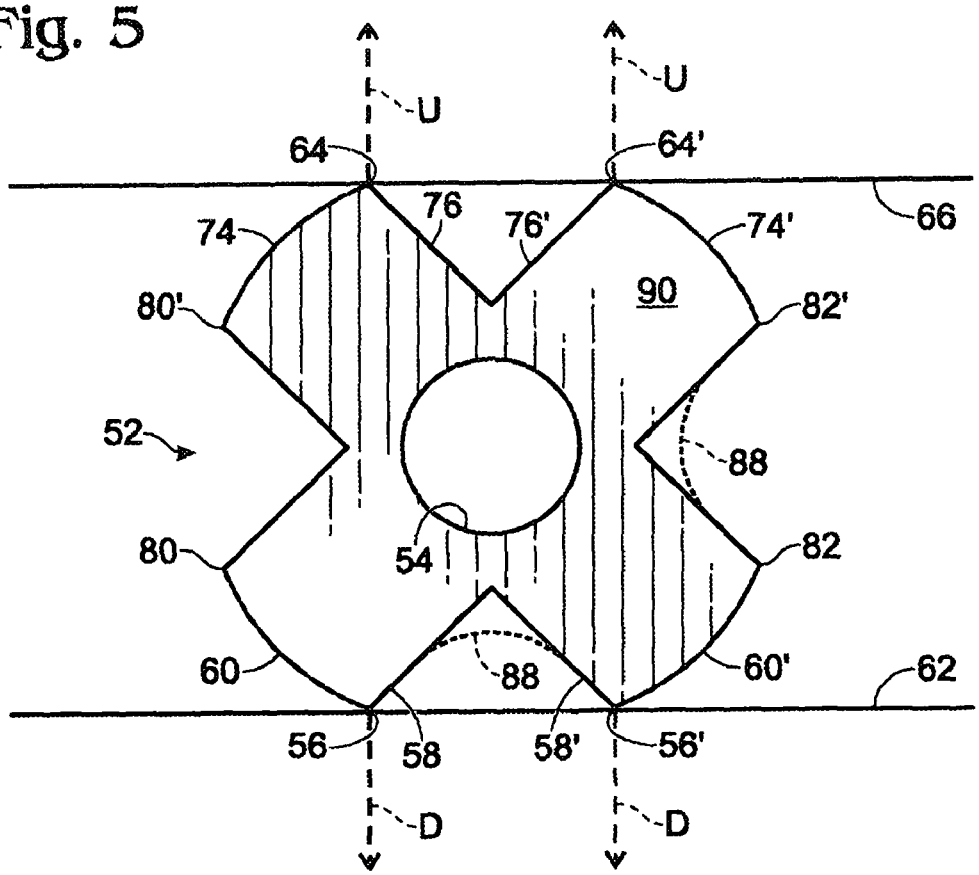
FIG. 5 is an end view of the cleat of FIG. 4.
Figure 7:
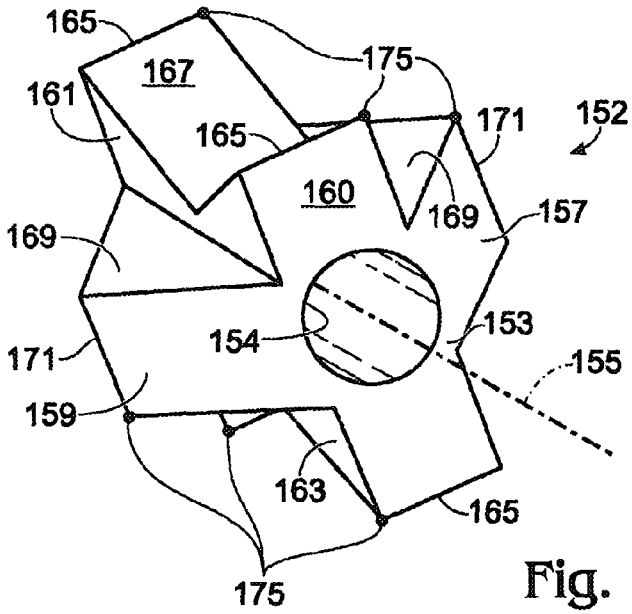
FIG. 7 is a perspective, enlarged view of another embodiment of a cleat component of the personal traction device.
Figure 8:
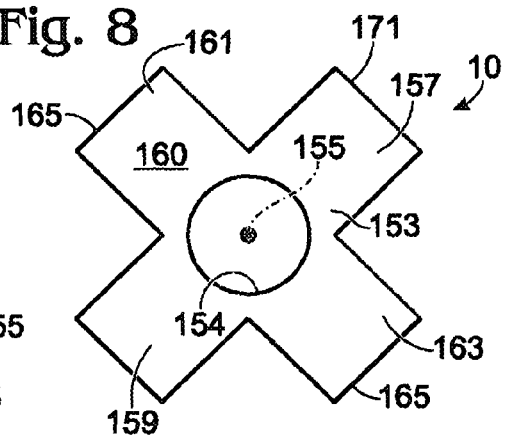
FIG. 8 is an end view of the cleat of FIG. 7.
Figure 9:
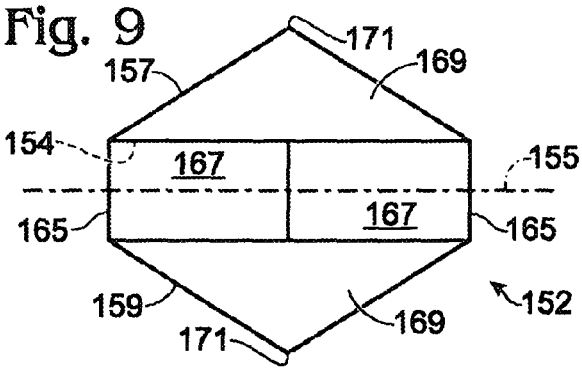
FIG. 9 is a side view taken along lines 9-9 of FIG. 8.
Figure 10:
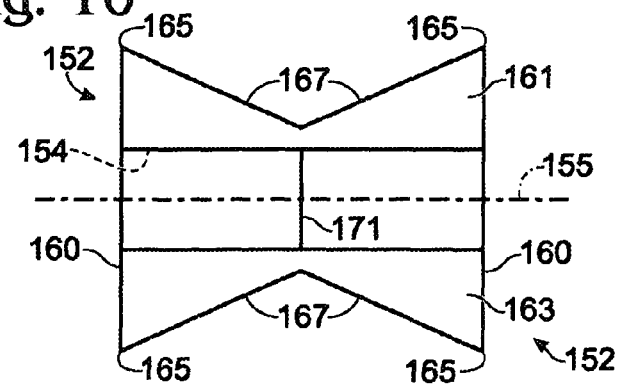
FIG. 10 is a side view taken along lines 10-10 of FIG. 8.

Each segment of the wire rope 34 is strung or threaded with cleats 52 and spacers 70 such that a spacer 70 is located between each cleat 52. FIGS. 4 and 5 respectively illustrate in enlarged perspective and end views the details of on embodiment of a cleat 52 made in accordance with the present invention.

In particular, each cleat 52 depicted in the embodiment of FIGS. 4 and 5 is formed of durable metal, such as stainless steel, and is generally cross-shaped. The cleat includes a round through-passage 54 having a diameter (eg, 0.0781 inches or 2.0 mm) that is slightly larger than that of the wire rope that slides through the passage. Accordingly, the threaded cleat is free to rotate about the rope 34.

The cross-shaped cleat 52 defines several edges where two surfaces meet. For example, as shown in FIGS. 4 and 5, a first edge 56 of the cleat is defined by the junction of the two surfaces shown at 58 and 60. Another such edge 56' is defined by the junction of the two other surfaces shown at 58' and 60.' It is noteworthy that this pair of first edges 56, 56' are parallel to one another and reside in a common plane, which is indicated by the "ground" line 62 in FIG. 5.

The cleat 52 is symmetrical about its center. Accordingly, a pair of second edges 64, 64' matching but opposite to the first pair 56, 56' are defined on the opposing side of the cleat. Those edges 64, 64' are respectively defined by the junctions of surfaces 74, 76 and 74', 76' and likewise disposed in a common plane, which is shown by the "sole" line 66 in FIG. 5. Plane 66 is parallel to the opposing plane 62.

The configuration of the first set of edges 56, 56' as shown in FIG. 5, orients those edges to be pointing downwardly in the direction as shown by arrows "D" in FIG. 5. In this regard, a line that bifurcates the angle between the two surfaces that form the edge 56, 56' is aligned with the direction that the edge is "pointing." Thus, in FIG. 5 the edges 56, 56' are pointing in the downwardly direction "D," normal to the plane 62.

On the opposite side of the cleat 52, the second set of edges 64, 64' as shown in FIG. 5 are oriented so that those edges are pointing upwardly as indicated by arrows "U" in FIG. 5, perpendicular to the plane 66 in which the edges are disposed.

Considering further the cleat shown in FIG. 5, the lower or ground plane 62 may be considered the surface (such as an ice-covered walkway) upon which the cleat 52 bears when fastened to the sole of a boot as shown in FIG. 1. The opposing plane 66, in this instance, corresponds to the underside or sole of the boot 22.

Consequently, all of the cleats of the device, when pressed between the sole 66 and ground surface 62 by the weight of the wearer, will have a downwardly pointing pair of sharp edges forced into the icy surface for providing excellent traction. In this regard, the configuration of the cleat (as described above) is such that when pressed between two planes (FIG. 5) it will assume a stable equilibrium position. Specifically, the cleat rotates about the rope 24 by an amount sufficient to direct a pair of edges to rest upon or point to the lower surface, and an opposing pair of edges points to or engages the surface of the upper plane.

In one embodiment, the outermost radial surfaces of the cleat, such as surface 60' is formed to be slightly arched or convexly curved, which curvature may enhance the tendency of the cleat to arrive at its stable equilibrium orientation just discussed. It is contemplated, however, that such surfaces could also be flat, and the cleat would still move to its stable equilibrium orientation (FIG. 5) when pressed between two generally parallel planes.

As noted, the cleat is symmetrical so that the cleat shown in FIG. 5 will assume a stable equilibrium orientation at any one of four different positions. That is, the cleat will assume a stable equilibrium orientation when rotated by any integer multiple of 90 degrees beyond what is shown in FIG. 5. Put another way, a third pair of edges 80, 80' and opposing fourth pair of edges 82, 82' are formed in the cleat 52 to function in the same manner as the above-discussed first and second edge pairs in instances where the cleat happens to be rotated 90 degrees from the orientation shown in FIG. 5.

It is noteworthy that the effect of the upwardly pointing edges of the cleat (edges 64 and 64' in FIG. 5), in addition to helping to stabilize the cleat in the position where the opposing edges point directly into the slippery surface 62, is to provide cutting edges pointed toward the underside of the shoe. These edges tend to shear through ice, snow and other debris that may on occasion move between the cleat and the sole. In this regard, the upwardly pointing cleat edges provide a self-cleaning action for preventing unwanted buildup of material on the device.

Although the cleat shown in the figures has inner corners defining a 90-degree angle, it is contemplated that those corners could also be formed as concave curves, as shown by the dashed lines 88 in FIG. 5.

The opposing end faces 90 of the cleat are flat and reside in planes perpendicular to the long axis of the passage 54 in the cleat. It will be appreciated that where the end surfaces 90 join the edges (such as edges 56' or 64' shown in FIG. 4) there is defined a relatively sharp point 92 in the cleat. Consequently, each end of the cleat has associated with it eight sharp points 92. The wire rope upon which the cleats are carried is free to bend slightly to accommodate irregular surfaces, walking motions, etc. Consequently, the numerous sharp points 92 of the cleat will dig into the icy surface for enhancing traction, preventing sliding and otherwise supplement the traction provided by the edges discussed above.

Figure 6:
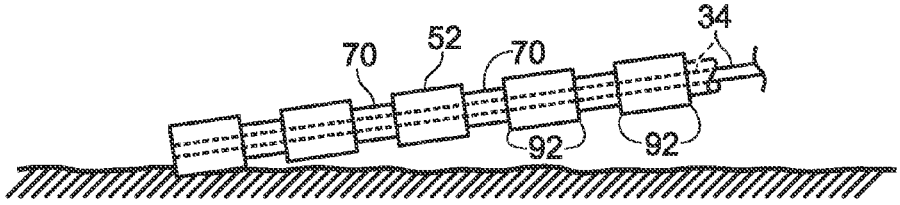
FIG. 6 shows a side view of a portion of a traction device.

The spacers 70 mentioned above (See FIGS. 1, 2, and 6) are hollow, cylindrical members, preferably made of stainless steel. As shown in FIG. 6, the outer diameter of the spacers is significantly less that the maximum cross sectional width of the cleats 52. As a result, the numerous sharp points 92 of the cleats are exposed (for supplementing traction) by a degree much greater than would be the case if the cleats were threaded adjacent to one another with no such spacers.

Figure 3:
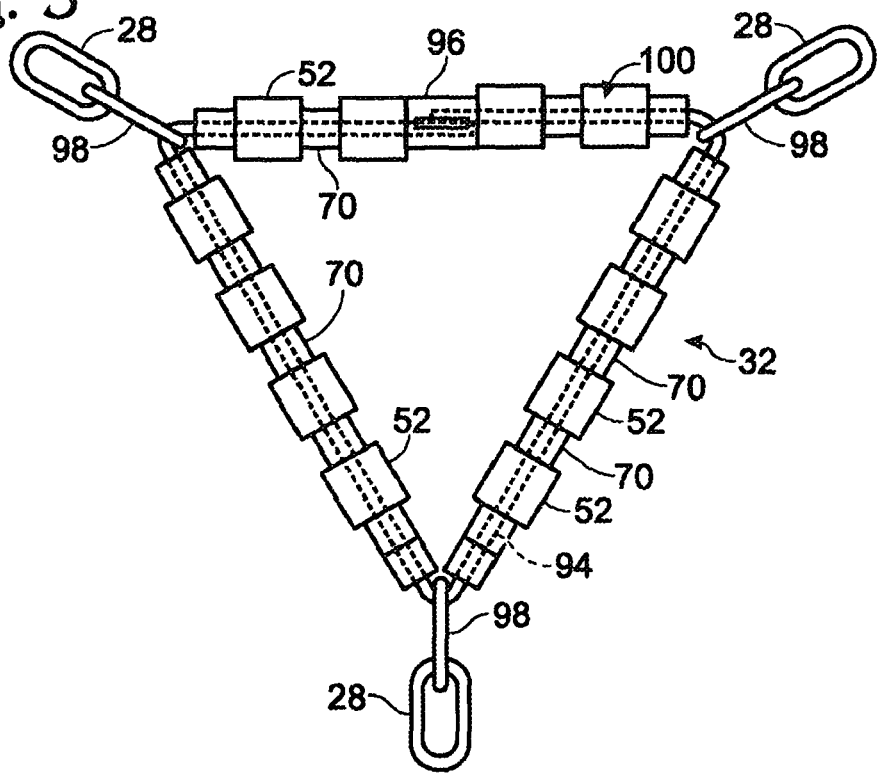
FIG. 3 is a plan view of a rear or heel assembly component of the personal traction device.

FIG. 3 shows in plan view the rearward or heel cable assembly 32 of the personal traction device. This assembly comprises a single length of stainless wire rope 94, having a 0.0625-inch (1.6 mm) diameter and shown in dashed lines. The ends of the rope 94 are fastened by a crimp 96. This assembly includes alternating cleats 52 and spacers 70 configured and arranged as described above in connection with the toe cable assembly 30.

Apex loops 98 are threaded onto the wire rope at each of three corners of the triangular-shaped heel assembly. Alternatively, crimps could be used instead of or in addition to these loops to define and stabilize the shape of the assembly. Each of the apex loops 98 is captured by a corresponding connector link 28 that extends from each tab 26 of the elastomeric member 24.

With continued reference to FIG. 3, the overall wire rope 94 can be considered as having three segments, each segment extending between an apex loop 98. For example, a transverse segment 100 of the assembly extends between the two forward apex loops.

FIGS. 7-10 illustrate another embodiment of a cleat component of the present invention. This cleat 152 is formed of durable material comprising, for example, stainless steel. The cleat 152 is generally cross-shaped and can be considered as having a central core portion 153. The core 153 of the cleat has flat, opposing end faces 160 and has formed through it a round through-passage 154 having a diameter (e.g., 2.0 mm) that is slightly larger than that of the wire rope that slides through the passage.

The passage 154 (like the earlier described passage 54) includes a central axis as shown in the figures as line 155 for reference purposes.

Four spaced apart protrusions 157, 159, 161, 163 extend radially outwardly from the core 153 of the cleat 152. These protrusions are evenly spaced apart from one another and are generally plate-like members, preferably having thicknesses (FIG. 8) slightly greater than the diameter of the passage 154.

In this embodiment, some of the protrusions are shaped to have sharp, bladed edges 165. Bladed edges are, for the purposes of this description, edges formed from surfaces that meet at an angle of less than 90 degrees. In the present embodiment, the bladed edges are provided on two diametrically opposed protrusions 161, 163 (See FIGS. 7 and 10).

Each bladed edge 165 is made up of the junction of two surfaces, one of which is a surface 167 that is formed so that it is inclined to be oblique (that is, neither parallel nor perpendicular) to the central axis 155 of the cleat. In this embodiment, that inclined surface 167 joins the extension of the end surface 160 of the cleat core (FIG. 10), thereby defining a tapered portion in the protrusion 161, 163 that terminates in the bladed edge 165. In a preferred embodiment, each protrusion 161, 163 has two inclined surfaces 167 and associated tapered portions, thus defining a bladed edge 165 on each of the opposite ends of the protrusion.

It is contemplated that a single inclined surface may be formed to extend along the length of the cleat and thus define a single bladed edge on one end of the cleat. Moreover, it is also contemplated that the cleat could be made with the end surface 160 of the cleat oriented to be inclined oblique to the central axis and thus serving as the inclined surface that imparts a taper into the protrusion and form a bladed edge. (For instance, in FIG. 4, the end face 90 of that cleat 52 may be formed obliquely to the central axis of the passage 54 and thereby defining at edge 60 a bladed edge as discussed in the present embodiment.)

It is noteworthy here that the bladed edges 165 described above are particularly useful for digging into ice-covered surfaces to improve traction. Moreover, all of the four protrusions may be formed with one or more such bladed edges. In the preferred embodiment, however, the other opposing pair of protrusions 157, 159 (See FIGS. 7 and 9) are each shaped to define a wedge 169. For the purposes of this description, a wedge is considered to be the shape resulting from the junction of two surfaces with an angle of 90 degrees or more between them. In the present embodiment (see, in particular, FIG. 9), the wedge 169 is formed by two inclined surfaces that extend from opposing ends of the protrusion to join midway between those ends and define a sharp, outermost edge 171 of the wedge.

In view of the foregoing description of the embodiment of FIGS. 7-10 it can be seen that the protrusions 157, 159, 161, 163 are arranged around the central axis 155 (FIG. 7) in a manner such that each protrusions 161, 163 shaped to have opposing bladed edges 165 is adjacent to a protrusion 157, 159 that is shaped as a wedge with a central outermost edge 171. One advantage to arranging the protrusions in this alternating manner is to maintain sufficient material in the cross section of the cleat (that is, along the axis 155) to increase durability of the cleat over what it might be if blade edges were formed on all four protrusions.

Moreover, in instances where, as in this embodiment, the protrusions are sized to extend radially outwardly by the same distance (see FIG. 8), the adjacent blade edges 165 and wedge edge 171 provide three tripodal points (shown at 175 in FIG. 7) that are disposed in a common plane and thus support the cleat 152 in a stable position upon a flat surface.

It will be appreciated that a similar tripodal arrangement of points 175 is provided on four sides of the cleat 152 (that is, at 90 degree intervals). As a result, the cleat 152, when pressed between a shoe sole and ground surface by the weight of the wearer (those surfaces shown, for example at 62 and 66 in FIG. 5), will provide a downwardly facing tripod of sharp points 175 forced into the icy surface for providing excellent traction, as well as an upwardly projecting tripod of sharp points 175 to engage the sole of the shoe.

The embodiments illustrated and described are not intended to be exhaustive or limit the invention to the precise form disclosed. The embodiments were chosen and described in order to explain the principles of the invention and its application and practical use, and thereby enable others skilled in the art to utilize the invention. Modifications, therefore, may be made to the preferred embodiments while still falling within the scope of the claims.

For example, each cable assembly could be modified to have more or fewer segments, or arranged in patterns other than the trapezoidal or triangular ones depicted here. Also, the tabs depending from the mounting strap may be equipped with rivets that capture one or more links for attachment to the loops on the wire rope. Such links may be bent or otherwise arranged so that the tab-to-wire rope connection rides smoothly over the boot. Moreover, it is also contemplated that many of the benefits of the configuration of the cleat 152 described above could be obtained if only three evenly spaced protrusions (rather than four) were employed.

The invention claimed is:

1. A traction device, comprising:
an elastomeric member;
a cable assembly connected to the elastomeric member and having an elongated segment;
a cleat carried on the segment; the cleat having:
an elongated core through which extends a passage having a central axis, and through which passage fits the segment so that the cleat is rotatably carried thereon;
at least three spaced apart protrusions extending radially from the core and including a first inclined surface on at least one of the protrusions and that is oblique to the central axis of the passage to thereby shape the protrusion such that the protrusion tapers to a first bladed edge.

2. The device of claim 1 wherein two of the spaced apart protrusions extending radially from the core include a second inclined surface thereon that is oblique to the central axis of the passage.

3. The device of claim 2 wherein the second inclined surface on each of the two protrusions shapes the associated protrusion to taper to a bladed edge, thereby to provide at least three bladed edges on the cleat.

4. The device of claim 1 wherein the cleat includes on one of the protrusions a second inclined surface that joins the first inclined surface to shape the protrusion as a wedge having an outermost edge.

5. The device of claim 4 wherein the outermost edge of the wedge is oblique to the central axis of the passage.

6. A traction device, comprising:
an elastomeric member;
a cable assembly connected to the elastomeric member and having an elongated segment;
a cleat carried on the segment; the cleat having:
an elongated core through which extends a passage having a central axis, and through which passage fits the segment so that the cleat is rotatably carried thereon;
wherein the cleat includes four protrusions extending radially from the core and wherein each one of a first pair of the protrusions includes a first inclined surface thereon that is oblique to the central axis of the passage to thereby shape the associated protrusion such that the protrusion tapers to a first bladed edge, and
wherein each one of a second pair of protrusions is shaped to define a wedge having an outermost edge that is oblique to the central axis of the passage.

7. The device of claim 6 wherein the protrusion are configured and arranged to provide a first set of three sharp points in a first common plane for supporting the cleat on a flat surface.

8. The device of claim 7 wherein the protrusions are configured and arranged to provide a second set of three sharp points in a second common plane that is substantially parallel to the first so that the cleat can be stably supported between two surfaces.

9. A traction device, comprising:
an elastomeric member;
a cable assembly connected to the elastomeric member and having an elongated segment;

a cleat carried on the segment; the cleat having:

an elongated core through which extends a passage having a central axis, and through which passage fits the segment so that the cleat is rotatably carried thereon;

a protrusion extending radially from the core and including a first inclined surface thereon that is oblique to the central axis of the passage to thereby shape the protrusion such that the protrusion tapers to a first bladed edge and further comprising spacers threaded on at least one segment and located adjacent to the cleat.

10. The device of claim 9 wherein the spacers are cylindrical and extend from the segment by a distance that is less than the maximum distance that a cleat extends from the segment.

11. The device of claim 1 wherein the passage extends between opposing end faces of the core and wherein the first inclined surface is one of the end faces.

12. The device of claim 1 wherein the cleat is comprised of stainless steel.

13. The device of claim 1 wherein the protrusion includes flat, parallel opposing side surfaces.

* * * * *